US007837602B1

(12) United States Patent
Drybread

(10) Patent No.: US 7,837,602 B1
(45) Date of Patent: Nov. 23, 2010

(54) PORTABLE PULL-UP APPARATUS AND ASSOCIATED METHOD

(76) Inventor: Michael J. Drybread, 66 Broad St., Freehold, NJ (US) 07728

( * ) Notice: Subject to any disclaimer, the term of this patent is extended or adjusted under 35 U.S.C. 154(b) by 0 days.

(21) Appl. No.: 12/618,344

(22) Filed: Nov. 13, 2009

Related U.S. Application Data

(60) Provisional application No. 61/199,151, filed on Nov. 13, 2008.

(51) Int. Cl.
*A63B 21/00* (2006.01)

(52) U.S. Cl. ..... 482/102; 482/38; 482/40

(58) Field of Classification Search ..... 482/102, 482/907, 77, 95, 148, 904
See application file for complete search history.

(56) References Cited

U.S. PATENT DOCUMENTS 5,072,934 A * 12/1991 Blanes ..... 482/94
6,095,954 A 8/2000 Svanberg
6,514,182 B1 * 2/2003 Chhloeum ..... 482/130
7,044,897 B2 5/2006 Myers
7,217,227 B2 5/2007 Finn
7,572,212 B2 * 8/2009 Cassidy et al. ..... 482/102

* cited by examiner

*Primary Examiner*—Jerome Donnelly

(57) ABSTRACT

A portable pull-up apparatus may include a plurality of hollow support poles and a plurality of pulley wheel sections. A pull-up bar may further be horizontally placed on top of the support poles. Weights may further be situated within an interior of the support poles. A plurality of cables provided with handles adapted to be gripped by a user may be wrapped about the pulley wheel sections such that the distal ends of the cables are guided inside the support poles respectively. A plurality of selector rods may be through the weight groups. A plurality of anchor pins may be positioned to lock selected weights. Further resistance bands may be situated within the interior of the support poles. In this way, corresponding resistance band groups may cooperate with corresponding weight groups to create a unique tension force opposing vertical displacement of the distal end of the cables respectively.

13 Claims, 7 Drawing Sheets

PORTABLE PULL-UP APPARATUS AND ASSOCIATED METHOD

CROSS REFERENCE TO RELATED APPLICATIONS

This application claims the benefit of U.S. Provisional Application No. 61/199,151, filed Nov. 13, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to exercise equipment and more particularly to a portable pull-up apparatus for providing a user with an easy and convenient means of performing a variety of pull-up exercises at different resistance levels according to the user's needs.

2. Prior Art

No matter what our occupation, all of us use our back every day when we're sitting, standing, lifting or even lying down. A back injury can result in pain, disability, and even loss of income if it prevents us from doing our job. Together with proper lifting techniques, back exercises are one of the most important things each of us can do to strengthen our backs and help protect them from accidental injury. Pull-ups have been called the "King of Back Exercises," the backbone of the back workout and the only one true test of upper-body strength.

But regardless of what you choose to call it, the pull-up is the most grueling exercise you can do for your upper back. When done properly, pull-ups maximize these functions (strengthening and protecting), making them one of the purest lats exercises. Different grips and body angles allow you to target the back in different ways, which in turn helps you to more fully develop your back. For example, the basic pull-up with an overhand shoulder-width grip stresses your outer lats, while the wide-grip pull-up with your back arched (pulling your mid-chest to the bar) stresses the middle of your back and involves your rear deltoids more. As you get stronger and a set of fifteen becomes easy, you can strap on a weight to develop your back even further.

Aside from being possibly the most effective back exercise available, the pull-up is also one of the safest—unlike cable rows and bent rows, which can put you at risk of lower-back injury due to improper form or excessive weight. These problems are eliminated with the pull-up. Even cheating on a pull-up won't hurt anything except your ego as you perform the knee-up/pull-up compound movement. Because pull-ups are so difficult (and in spite of their effectiveness), the pull-up bar at most gyms hovers ahead in bleak solitude—under-utilized, unloved and largely ignored. Sure, the occasional patron will stop by and hang from the bar to stretch or maybe do some hanging leg raises, but you can count on one hand the number of people who will grab hold and pull themselves skyward. That's unfortunate, because the pull-up, in all its variations, is without peer in developing upper lats, the muscles responsible for pulling your upper arms backward and skyward and toward the sides of your body.

Accordingly, a need remains for an apparatus in order to overcome the above-noted shortcomings. The present invention satisfies such a need by providing an apparatus that is convenient and easy to use, lightweight yet durable in design, versatile in its applications, and designed for providing a user with an easy and convenient means of performing a variety of pull-up exercises at different resistance levels according to the user's needs in the privacy of his or her own home.

BRIEF SUMMARY OF THE INVENTION

In view of the foregoing background, it is therefore an object of the present invention to provide an apparatus for assisting a user to perform pull-up exercises between a framed opening. These and other objects, features, and advantages of the invention are provided by a portable pull-up apparatus.

The portable pull-up apparatus may include a plurality of hollow support poles spaced apart and registered parallel to each other and a plurality of pulley wheel sections attached to the top ends of the support poles. A pull-up bar may further be horizontally placed on top of the support poles and adapted to be frictionally engaged within the framed opening such that the pull-up bar is registered perpendicular to the support poles. A first and second group of weights may further be situated within an interior of the support poles. A plurality of cables each having a proximal end may be situated exterior of the support poles and provided with a handle adapted to be gripped by a user. The cables may further be wrapped about the pulley wheel sections such that the distal ends of the cables are guided inside the support poles respectively.

A plurality of selector rods may be attached to the distal ends of the cables and may further be positioned through the first and second weight groups respectively. A plurality of anchor pins may be positioned through the selector rods thereby locking selected weights of the first and second weight groups to the selector rod. Further, a first and second group of resistance bands may be situated within the interior of the support poles respectively such that the first and second resistance band groups are anchored to the first and second weight groups respectively. In this way, corresponding ones of the first and second resistance band groups may cooperate with corresponding ones of the first and second weight groups and thereby create a unique tension force opposing vertical displacement of the distal end of the cables respectively. Such an arrangement provides the unexpected and unpredictable advantage of adjustably varying the resistance level of the cables by selectively positioning the selector rod into desired weight groups to lessen or increase the tension on the cables.

The distal end of the cables may further be provided with a hook attached thereto such that the hooks are coupled to the selector rods and may remain spaced above the first and second weight groups. Each of the cables may be independently displaced along a longitudinal length of a corresponding one of the support poles and thereby causes corresponding ones of the first and second weight and resistance band groups to vertically travel along the longitudinal length of the first and second poles respectively. The first and second weight groups may further be vertically stacked within the interiors of the first and second support poles respectively. Such an arrangement provides the unexpected and unpredictable advantage of providing an equal resistance to the cables such that a user's right and left body portions are equally resisted as he/she performs the pull-up exercises.

A plurality of anchor brackets may be positioned within the support poles respectively such that the first and second ones of the anchor brackets are statically mated to the first and second resistance band groups respectively. In this way, selected ones of the resistance bands in each of the first and second resistance band groups may remain at an equilibrium position when corresponding ones of the weights in each of the first and second weight groups are not anchored to the selector rods respectively. Such an arrangement provides the unexpected and unpredictable advantage of allowing the weights in each of the weight groups to be selected to provide a range of incremental weight and resistance levels for a user to select according to his strength and exercise requirements.

The invention may further include a method for a user to perform pull-up exercises between a framed opening. Such a method preferably include the chronological steps of: providing and spacing apart a plurality of hollow support poles; providing and registering the support poles parallel to each other; providing and attaching a plurality of pulley wheel sections to top ends of the support poles respectively; providing and registering the pull-up bar perpendicular to the support poles by horizontally placing a pull-up bar on top of the support poles; and providing and frictionally engaging the pull-up bar within the framed opening.

The method may further include the chronological steps of: providing and situating first and second groups of weights within an interior of the support poles respectively; providing and situating proximal ends of a plurality of cables exterior of the support poles; providing and attaching a handle to each the proximal end of the cables respectively; guiding the distal ends of the cables inside the support poles by wrapping the cables about the pulley wheel sections respectively; providing and positioning a plurality of selector rods through the first and second weight groups by respectively attaching the selector rods to distal ends of the cables.

Such a method may further include the chronological steps of: locking selected weights of the first and second weight groups to the selector rods by providing and positioning a plurality of anchor pins through the selector rods respectively; providing and anchoring first and second resistance band groups to the first and second weight groups respectively by situating the first and second resistance band groups within the interior of the support poles respectively; and providing and creating a unique tension force opposing vertical displacement of each the respective distal end of the cables by cooperating corresponding ones of the first and second resistance band groups with corresponding ones of the first and second weight groups.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
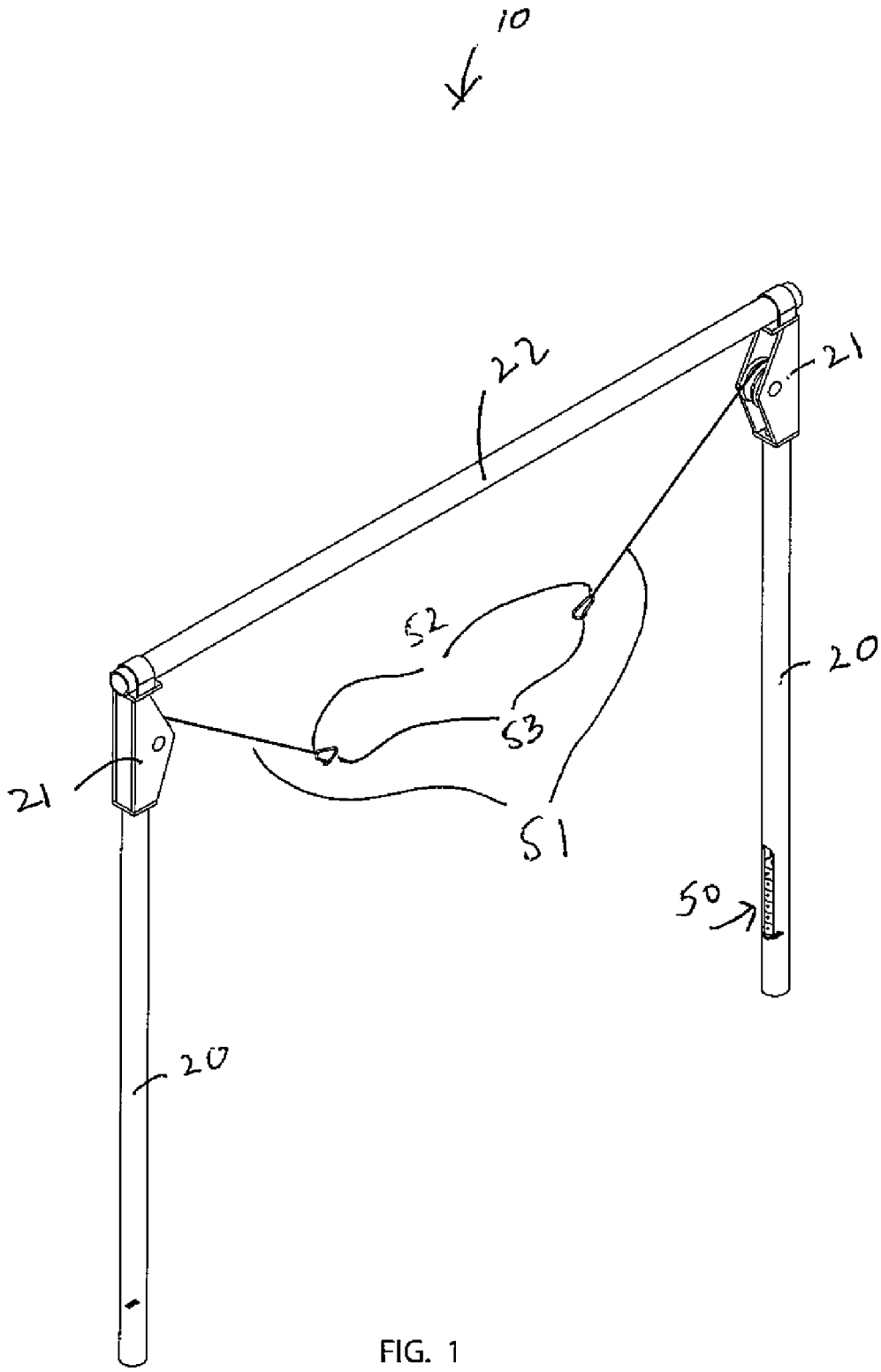
FIG. 1 is a perspective view showing a portable pull-up apparatus, in accordance with the present invention.
Figure 2:
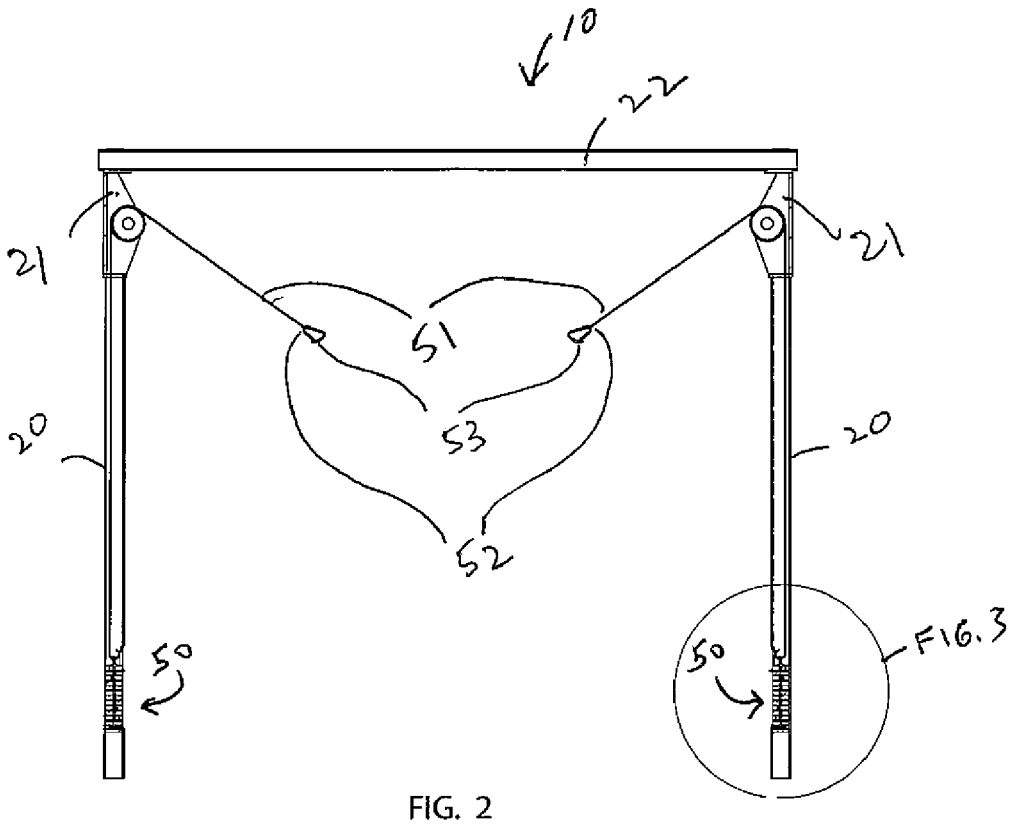
FIG. 2 is a cross-sectional view showing the vertically stacked orientation of the weight groups inside the poles.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-11 by the reference numeral 10 and is intended to provide a portable pull-up apparatus. It should be understood that the portable pull-up apparatus 10 may be used to perform a variety of pull-up exercises as well as many other different types of resistance exercises.

Referring generally to FIGS. 1-11, the portable pull-up apparatus 10 may include a plurality of hollow support poles 20 spaced apart and registered parallel to each other. A plurality of pulley wheel sections 21 are attached to the top ends of the support poles 20. A pull-up bar 22 may be horizontally placed on top of the support poles 20 and adapted to be frictionally engaged within the framed opening 11 such that the pull-up bar 22 is registered perpendicular to the support poles 20. A first and second group of weights 50 may further be situated within an interior 41 of the support poles 20, respectively. The first and second weight groups 50 may further be vertically stacked within the interiors 41 of the first and second support poles 20, respectively.

A plurality of cables 51 each have a proximal end 52 situated exterior of the support poles 20 and provided with a handle 53 adapted to be gripped by a user. The cables 51 may be wrapped about the pulley wheel sections 21 such that the distal ends 54 of the cables 51 are guided inside the support poles 20, respectively. A plurality of selector rods 55 may be attached to the distal ends 54 of cables 51 and may further be positioned through the first and second weight groups 50, respectively. A plurality of anchor pins 56 may be positioned through the selector rods 55 thereby locking selected weights of the first and second weight groups 50 to the selector rods 55.

Figure 6:
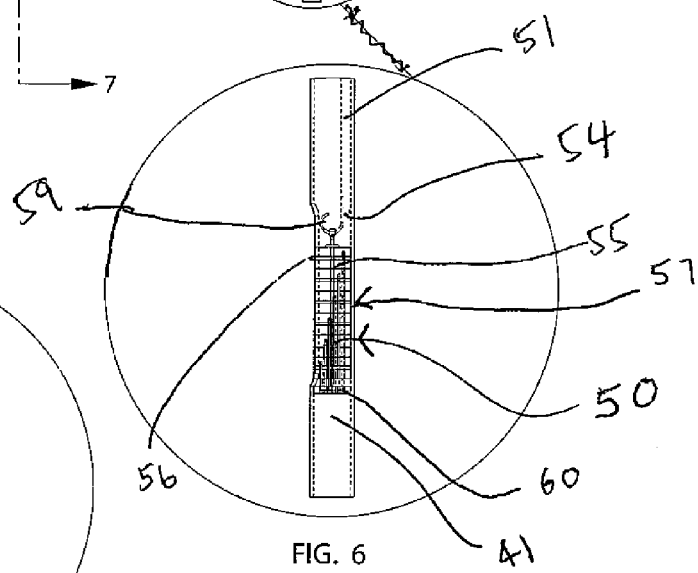
FIG. 6 is an enlarged transparent view showing the interrelationship between the weight group and resistance band group, and selector rod in each support pole.
Figure 7:
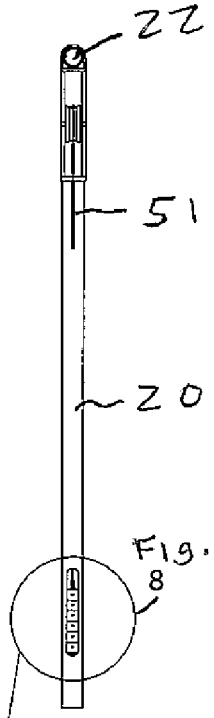
FIG. 7 is a cross-sectional view taken along line 7-7 in FIG. 4.
Figure 8:
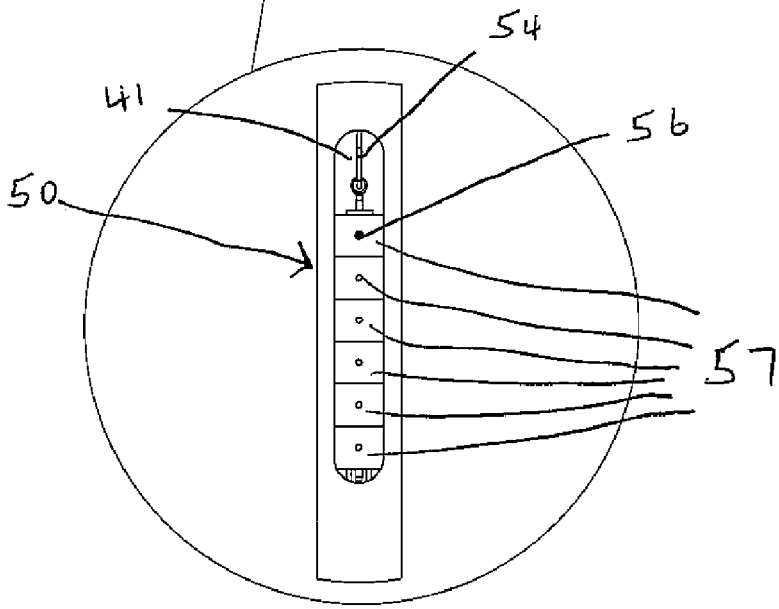
FIG. 8 is an enlarged view showing the vertically stacked orientation of the weight groups in FIG. 7.
Figure 9:
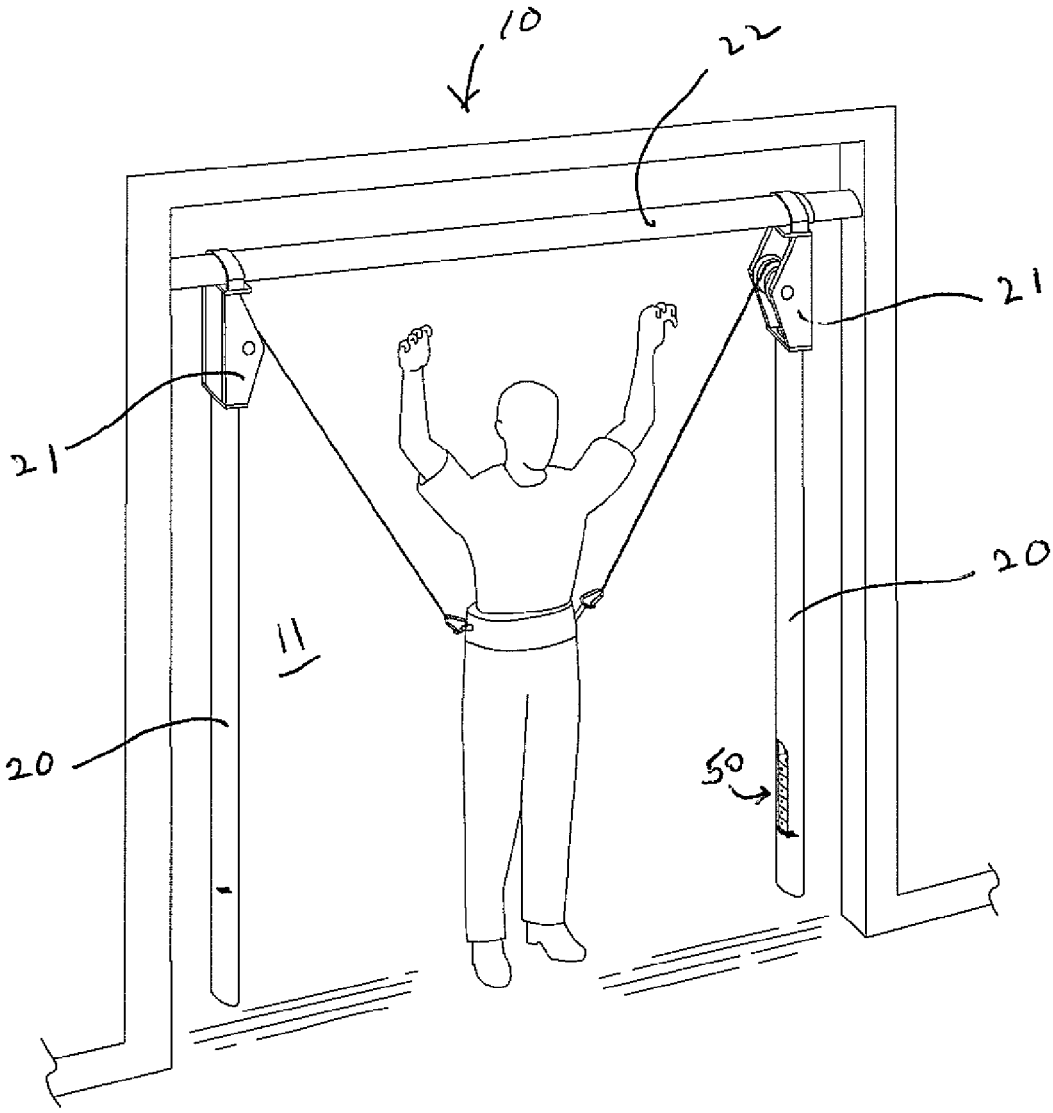
FIG. 9 is a perspective view showing the relative position of the user and the cables in a set-up position.
Figure 10:
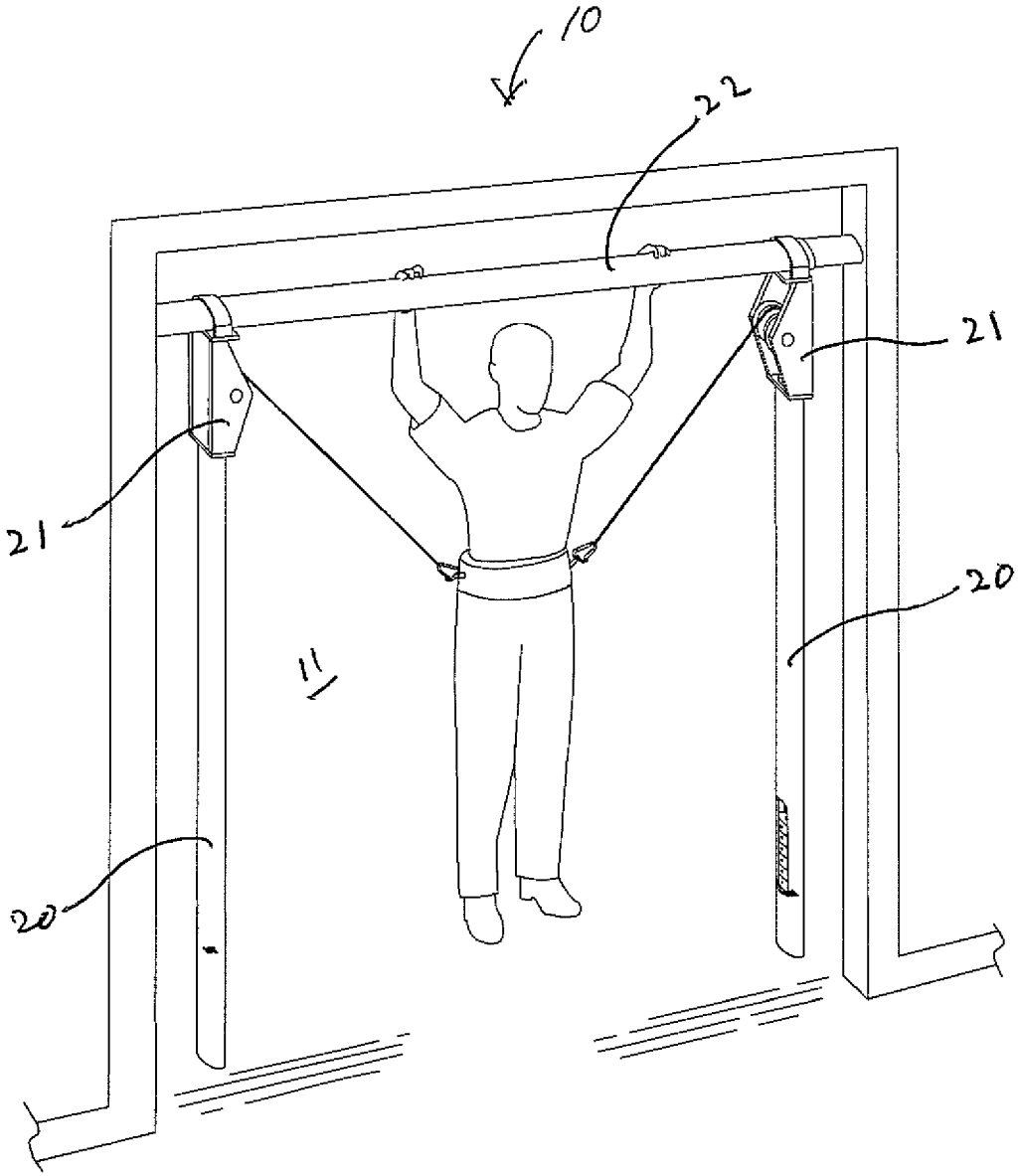
FIG. 10 is a perspective view showing the relative position of the user and the cables at a partially elevated position.
Figure 11:
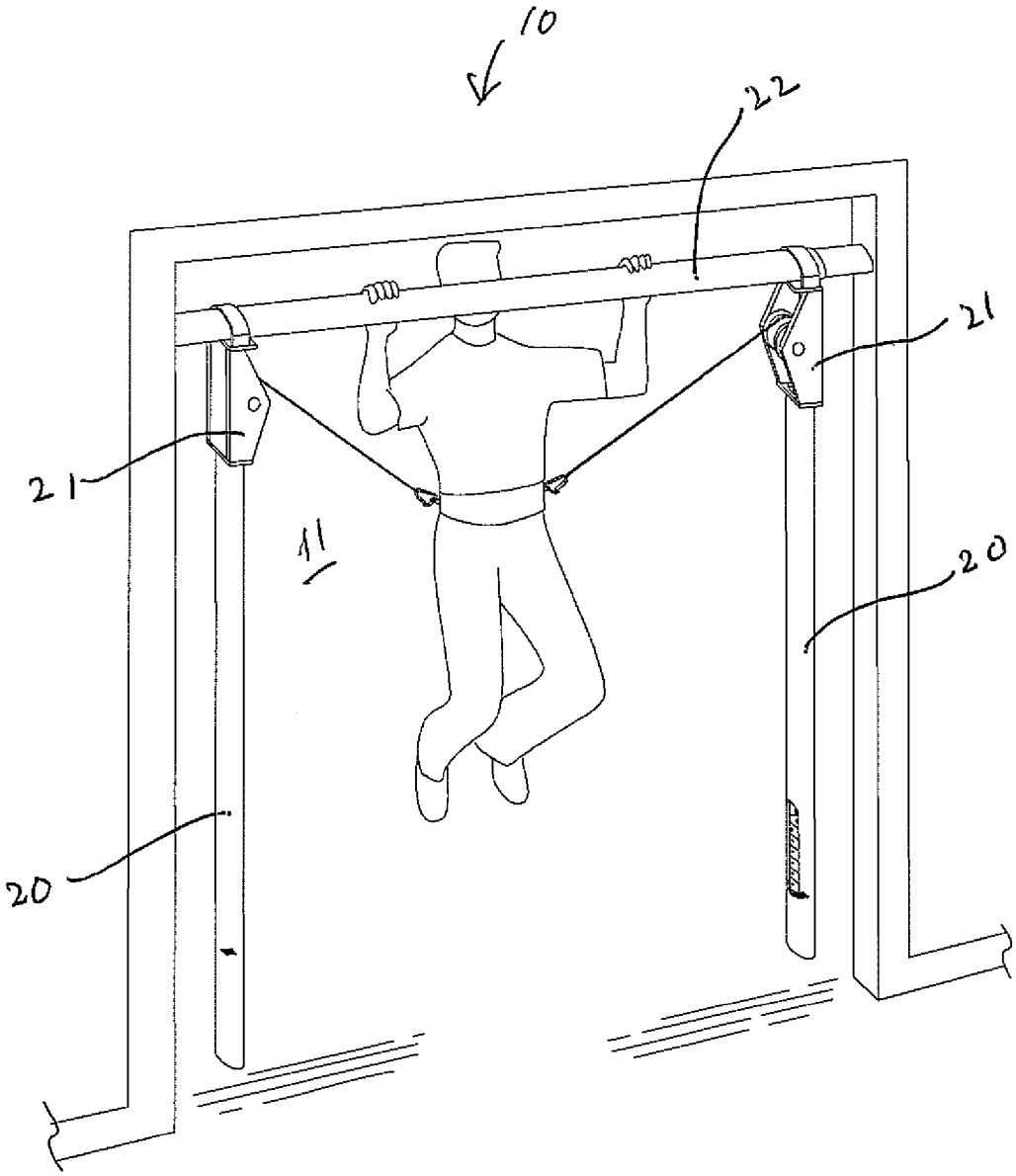
FIG. 11 is a perspective view showing the relative position of the user and the cables at a fully elevated position.

Further, first and second groups of resistance bands 57 may be situated within the interior 41 of the support poles 20, respectively, such that the first and second resistance band groups 57 are anchored to the first and second weight groups 50, respectively. It is understood that FIG. 6 illustrates an exemplary embodiment of the resistance bands 57 and weight groups 50, which are situated in each pole 20. In this way, corresponding ones of the first and second resistance band groups 57 may cooperate with corresponding ones of the first and second weight groups 50 and thereby create a unique tension force opposing vertical displacement of the distal end 54 of the cables 51, respectively. Such an arrangement provides the unexpected and unpredictable advantage of adjustably varying the resistance level of the cables 51 by selectively positioning the selector rods 55 into desired weight groups 50 to lessen or increase the tension on the cables 51.

Figure 3:
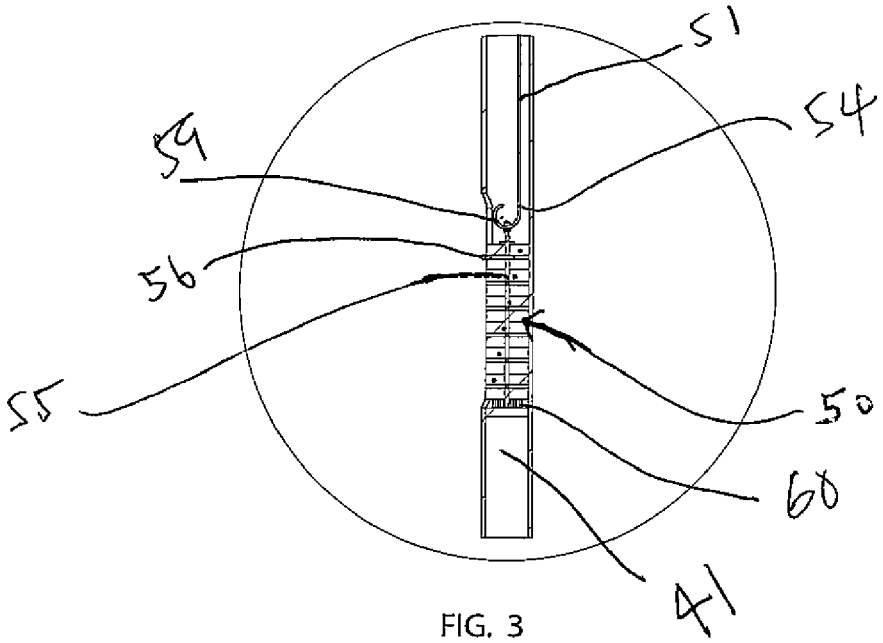
FIG. 3 is an enlarged view showing the interrelationship between the cable, weights and selector rod within the interior of the support poles.
Figure 4:
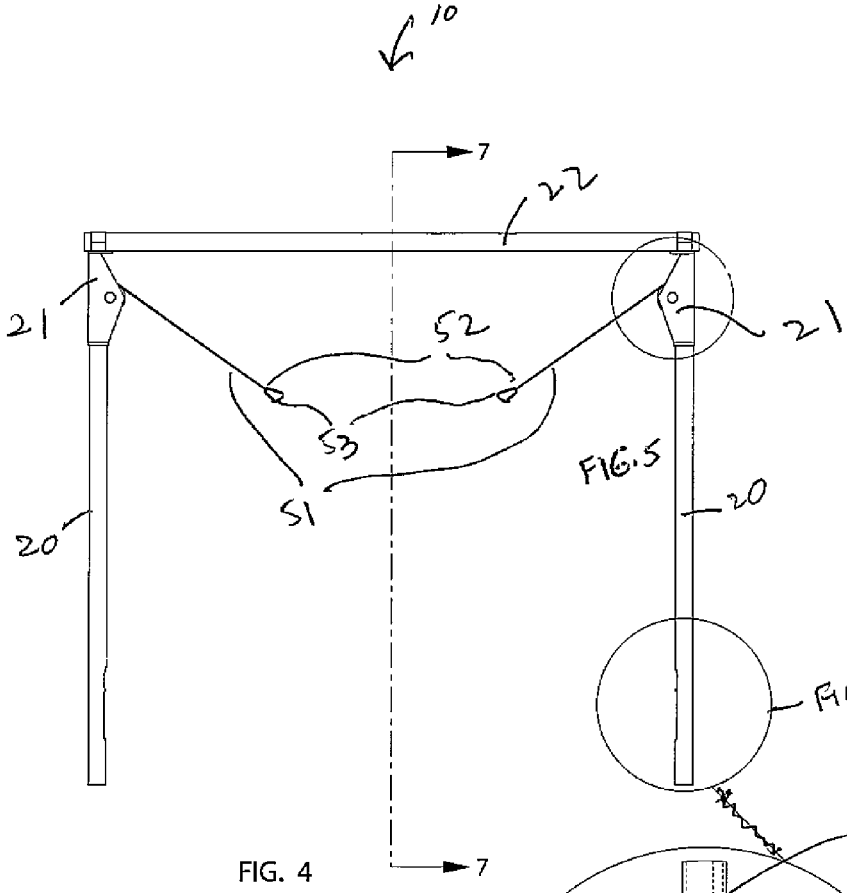
FIG. 4 is a front elevational view of the apparatus shown in FIG. 1.
Figure 5:
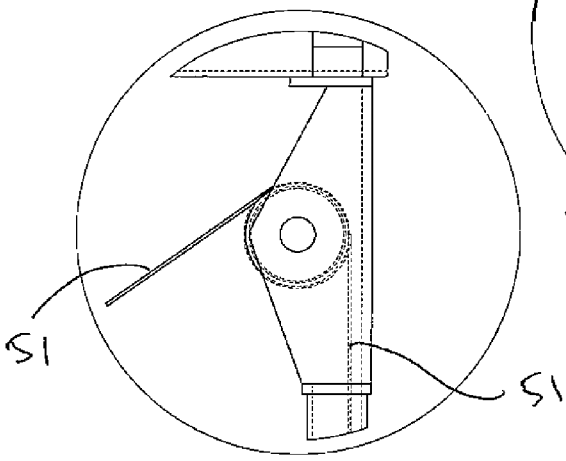
FIG. 5 is an enlarged transparent view of the pulley wheel section shown in FIG. 4.

Referring to FIGS. 3 and 6, the distal end of cables 51 may be provided with a hook 59 attached thereto such that hooks 59 are coupled to the selector rods 55 and remain spaced above the first and second weight groups 50. Each of the cables 51 may be independently displaced along a longitudinal length of a corresponding one of the support poles 20 and thereby causes corresponding ones of the first and second weight and resistance band groups 50, 57, respectively, to vertically travel along the longitudinal length of the first and second poles 20, respectively. Such an arrangement provides the unexpected and unpredictable advantage of providing equal resistance to cables 51 such that a user's right and left body portions are equally resisted as he/she performs the pull-up exercises.

Referring to FIGS. 3 and 6, a plurality of anchor brackets 60 may be positioned within the support poles 20, respectively, such that first and second ones of the anchor brackets 60 are statically mated to first and second resistance band groups 57, respectively. In this way, selected ones of the resistance bands in each of the first and second resistance band groups 57 may remain at an equilibrium position when corresponding ones of the weights in each of the first and second weight groups 50 are not anchored to the selector rods 55, respectively. Such an arrangement provides the unexpected and unpredictable advantage of allowing the weights 50 in each of the weight groups to be selected to provide a range of incremental weight and resistance levels for a user to select according to his strength and exercise regime.

The invention may further include a method for a user to perform pull-up exercises between a framed opening 11. Such a method preferably include the chronological steps of: providing and spacing apart a plurality of hollow support poles 20; providing and registering the support poles 20 parallel to each other; providing and attaching a plurality of pulley wheel sections 21 to top ends of the support poles 20 respectively; providing and registering the pull-up bar 22 perpendicular to the support poles 20 by horizontally placing a pull-up bar 22 on top of the support poles 20; and providing and frictionally engaging the pull-up bar 22 within the framed opening 11.

The method may further include the chronological steps of: providing and situating first and second groups of weights 50 within an interior 41 of the support poles 20, respectively; providing and situating proximal ends 52 of a plurality of cables 51 exterior of the support poles 20; providing and attaching a handle 53 to each proximal end 52 of cables 51 respectively; guiding distal ends 54 of cables 51 inside the support poles 20 by wrapping cables 51 about the pulley wheel sections 21, respectively; providing and positioning a plurality of selector rods 55 through first and second weight groups 50 by respectively attaching selector rods 55 to distal ends 54 of cables 51.

The method may further include the chronological steps of: locking selected weights of first and second weight groups 50 to selector rods 55 by providing and positioning a plurality of anchor pins 56 through the selector rods 55, respectively; providing and anchoring first and second resistance band groups 57 to the first and second weight groups 50, respectively, by situating the first and second resistance band groups 57 within the interior 41 of the support poles 20, respectively; and providing and creating a unique tension force opposing vertical displacement of each respective distal end 54 of cables 51 by cooperating corresponding ones of the first and second resistance band groups 57 with corresponding ones of the first and second weight groups 50. The combination of such claimed method steps provides an unpredictable and unexpected benefit of assisting a user to perform pull-up exercises with less effort. Further, the adjustable resistant bands in combination with the weight groups provide a consistent and uniform increase and decrease of tension force.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable pull-up apparatus for assisting a user to perform pull-up exercises between a framed opening, said portable pull-up apparatus comprising:

a plurality of hollow support poles spaced apart and registered parallel to each other;

a plurality of pulley wheel sections attached to top ends of said support poles respectively;

a pull-up bar horizontally placed on top of said support poles and adapted to be frictionally engaged within the framed opening such that said pull-up bar is registered perpendicular to said support poles;

first and second groups of weights situated within an interior of said support poles respectively;

a plurality of cables each having a proximal end situated exterior of said support poles and provided with a handle adapted to be gripped by the user, said cables being wrapped about said pulley wheel sections such that distal ends of said cables are guided inside said support poles respectively;

a plurality of selector rods attached to distal ends of said cables and being positioned through said first and second weight groups respectively;

a plurality of anchor pins positioned through said selector rods respectively and thereby locking selected weights of said first and second weight groups to said selector rod; and first and second groups of resistance bands anchored to said first and second weight groups respectively;

wherein corresponding ones of said first and second resistance band groups cooperate with corresponding ones of said first and second weight groups and thereby create a unique tension force opposing vertical displacement of said distal end of said cables respectively.

2. The portable pull-up apparatus of claim 1, wherein each said distal end of said cables are provided with a hook attached thereto, said hooks being coupled to said selector rods and remaining spaced above said first and second weight groups.

3. The portable pull-up apparatus of claim 2, wherein each of said cables is independently displaced along a longitudinal length of a corresponding one of said support poles and thereby causes corresponding ones of said first and second weight and resistance band groups to vertically travel along said longitudinal length of said first and second poles respectively.

4. The portable pull-up apparatus of claim 3, wherein said first and second weight groups are vertically stacked within said interiors of said first and second support poles respectively.

5. The portable pull-up apparatus of claim 4, further comprising: a plurality of anchor brackets positioned within said support poles respectively, wherein first and second ones of said anchor brackets are statically mated to said first and second resistance band groups respectively.

6. The portable pull-up apparatus of claim 1, wherein selected ones of said resistance bands in each of said first and second resistance band groups remains at an equilibrium position when corresponding ones of said weights in each of said first and second weight groups are not anchored to said selectors rods respectively.

7. A portable pull-up apparatus for assisting a user to perform pull-up exercises between a framed opening, said portable pull-up apparatus comprising:

a plurality of hollow support poles spaced apart and registered parallel to each other;

a plurality of pulley wheel sections attached to top ends of said support poles respectively;

a pull-up bar horizontally placed on top of said support poles and adapted to be frictionally engaged within the framed opening such that said pull-up bar is registered perpendicular to said support poles;

first and second groups of weights situated within an interior of said support poles respectively;

a plurality of cables each having a proximal end situated exterior of said support poles and provided with a handle adapted to be gripped by the user, said cables being wrapped about said pulley wheel sections such that distal ends of said cables are guided inside said support poles respectively;

a plurality of selector rods attached to said distal ends of said cables and being positioned through said first and second weight groups respectively;

a plurality of anchor pins positioned through said selector rods respectively and thereby locking selected weights of said first and second weight groups to said selector rod; and first and second groups of resistance bands situated within said interior of said support poles respectively such that said first and second resistance band groups are anchored to said first and second weight groups respectively;

wherein corresponding ones of said first and second resistance band groups cooperate with corresponding ones of said first and second weight groups and thereby create a unique tension force opposing vertical displacement of said distal end of said cables respectively.

8. The portable pull-up apparatus of claim 7, wherein each said distal end of said cables are provided with a hook attached thereto, said hooks being coupled to said selector rods and remaining spaced above said first and second weight groups.

9. The portable pull-up apparatus of claim 8, wherein each of said cables is independently displaced along a longitudinal length of a corresponding one of said support poles and thereby causes corresponding ones of said first and second weight and resistance band groups to vertically travel along said longitudinal length of said first and second poles respectively.

10. The portable pull-up apparatus of claim 9, wherein said first and second weight groups are vertically stacked within said interiors of said first and second support poles respectively.

11. The portable pull-up apparatus of claim 10, further comprising: a plurality of anchor brackets positioned within said support poles respectively, wherein first and second ones of said anchor brackets are statically mated to said first and second resistance band groups respectively.

12. The portable pull-up apparatus of claim 7, wherein selected ones of said resistance bands in each of said first and second resistance band groups remains at an equilibrium position when corresponding ones of said weights in each of said first and second weight groups are not anchored to said selectors rods respectively.

13. A method of utilizing a portable pull-up apparatus for assisting a user to perform pull-up exercises between a framed opening, said method comprising the chronological steps of:

providing and spacing apart a plurality of hollow support poles;

registering said support poles parallel to each other;

providing and attaching a plurality of pulley wheel sections to top ends of said support poles respectively;

providing and registering said pull-up bar perpendicular to said support poles by horizontally placing a pull-up bar on top of said support poles;

frictionally engaging said pull-up bar within the framed opening;

providing and situating first and second groups of weights within an interior of said support poles respectively;

providing and situating proximal ends of a plurality of cables exterior of said support poles;

providing and attaching a handle to each said proximal end of said cables respectively;

guiding said distal ends of said cables inside said support poles by wrapping said cables about said pulley wheel sections respectively;

providing and positioning a plurality of selector rods through said first and second weight groups by respectively attaching said selector rods to distal ends of said cables;

locking selected weights of said first and second weight groups to said selector rods by providing and positioning a plurality of anchor pins through said selector rods respectively;

providing and anchoring first and second resistance band groups to said first and second weight groups respectively by situating said first and second resistance band groups within said interior of said support poles respectively; and creating a unique tension force opposing vertical displacement of each said respective distal end of said cables by cooperating corresponding ones of said first and second resistance band groups with corresponding ones of said first and second weight groups.

* * * * *